US005319171A

United States Patent [19]

Tazawa

[11] Patent Number: 5,319,171

[45] Date of Patent: Jun. 7, 1994

[54] COOKING APPLIANCE WITH A GAS SENSOR AND TEMPERATURE SENSOR

[75] Inventor: Takako Tazawa, Tokyo, Japan

[73] Assignee: Kabushiki Kaisha Toshiba, Kawasaki, Japan

[21] Appl. No.: 67,827

[22] Filed: May 27, 1993

[30] Foreign Application Priority Data

May 27, 1992 [JP] Japan ..... 4-134935

[51] Int. Cl.[5] ..... H05B 6/64

[52] U.S. Cl. ..... 219/705; 219/492; 219/703; 219/707; 99/325

[58] Field of Search ..... 219/10.55 B, 10.55 E, 219/10.55 M, 492; 426/231, 241, 243; 99/325, DIG. 14

[56] References Cited

U.S. PATENT DOCUMENTS

| | | | |
|---|---|---|---|
| 4,350,860 | 9/1982 | Ueda . | |
| 4,376,131 | 3/1983 | Mori et al. | 219/10.55 M |
| 4,379,964 | 4/1983 | Kanazawa et al. | 219/10.55 B |
| 4,476,372 | 10/1984 | Prucher | 219/120 |
| 4,588,870 | 5/1986 | Nadkarni et al. | 219/119 |
| 4,678,887 | 7/1987 | Nagel et al. | 219/117.1 |
| 4,692,597 | 9/1987 | Tsuda et al. . | |
| 4,728,765 | 3/1988 | Prucher | 219/120 |
| 4,734,555 | 3/1988 | Ferguson | 219/110 |
| 4,760,235 | 7/1988 | Flater | 219/119 |

FOREIGN PATENT DOCUMENTS

| | | | |
|---|---|---|---|
| 62-3885 | 1/1987 | Japan | 219/119 |
| 1118503 | 10/1984 | U.S.S.R. | 219/120 |
| 2045469 | 10/1980 | United Kingdom . | |

*Primary Examiner*—Philip H. Leung
*Attorney, Agent, or Firm*—Cushman, Darby & Cushman

[57] ABSTRACT

A cooking appliance, which automatically toasts bread, and has a heater, a gas sensor, and a thermistor. The gas sensor detects moisture which comes from the bread. The thermistor detects the temperature within the cooking cabinet. A microcomputer measures gas driven from bread during toasting to determine whether the bread was initially frozen or not. The time of gas sensor reading is determined based on an initial temperature within the cooking cabinet so that the decision will not be made inaccurately due to repeated use of the cooking appliance.

18 Claims, 5 Drawing Sheets

COOKING APPLIANCE WITH A GAS SENSOR AND TEMPERATURE SENSOR

BACKGROUND OF THE INVENTION

The present invention relates to a automatic cooking appliance which includes a "toast" function. A gas sensor detects gas generated by bread being toasted. Using the gas sensor, a controller can determine the amount of gas driven off from the bread during a predetermined period of time after toasting begins. From this measurement, it can determine whether bread being toasted was initially frozen or at room temperature. Based on this determination, heating can be adjusted to properly toast the bread regardless of its initial state.

It is known to include in a cooking appliance having a toast function a gas sensor for measuring the amount of moisture driven off from bread being toasted in order to determine whether the bread was initially at room temperature or was frozen. The cooking appliance automatically toasts the bread for a time appropriate to the so determined state of the bread.

As a heater heats the bread in the cooking cabinet, it drives moisture from the bread. If the bread is frozen at the time toasting begins, the moisture is locked in the bread as ice. In the first moments of toasting, little moisture will be driven off. Conversely, if the bread is initially at room temperature, considerable moisture will be driven off during the first few moments of toasting.

When the gas sensor detects the increasing rate of the moisture during a predetermined period of time from the starting of the heater, a microprocessor based controller can discriminate the initial condition or state of the bread, i.e., whether it was initially frozen or at room temperature. If the bread were determined to be initially frozen, the cooking appliance would adjust its toasting program to properly toast the initially frozen bread. For example, heat could be applied for a longer time, the temperature could be raised, etc. Thus, regardless of whether the bread was initially frozen or not, it would be properly toasted.

Such appliances operate satisfactorily when they are operated intermittently. However, when such appliances are operated continuously, i.e., to toast one piece of bread after another, the toasting function is not properly adjusted. The problem exists because of residual heat remaining in the cooking cabinet after toasting. As the appliance is used more and more, this residual heat builds up even more. When a slice of bread is put into the cooking cabinet, even though the bread may be frozen, much moisture is driven from it. The cooking appliance is unable to properly discriminate between normal bread and frozen bread. All breads, whether frozen or not, are determined to be initially un-frozen). The cooking appliance may not toast the frozen bread properly.

SUMMARY OF THE INVENTION

It is an object of the present invention to provide a cooking appliance which can automatically determine whether or not bread to be toasted is frozen, even if the cooking appliance has been repeatedly operated.

In order to achieve the above object of the present invention, the present invention provides an arrangement that changes the time at which the gas sensor is "read" based upon an initial temperature in the cooking cabinet.

The cooking appliance, according to the present invention, has a cooking cabinet to receive food to be cooked and a heater in the cooking cabinet. Gas and temperature sensors are provide inside the cabinet. A controller, responsive to the gas and temperature sensors, controls the heater based on gas detected during a first predetermined period of time when the temperature is not greater than a predetermined temperature. However, when the temperature is greater than the predetermined temperature, the control means controls the heater based on gas detected during a second predetermined period of time earlier than the first period of time.

The present invention also contemplates a method according to the above.

DESCRIPTION OF THE PREFERRED EMBODIMENT

An embodiment of the present invention will now be described as follows.

Figure 1:
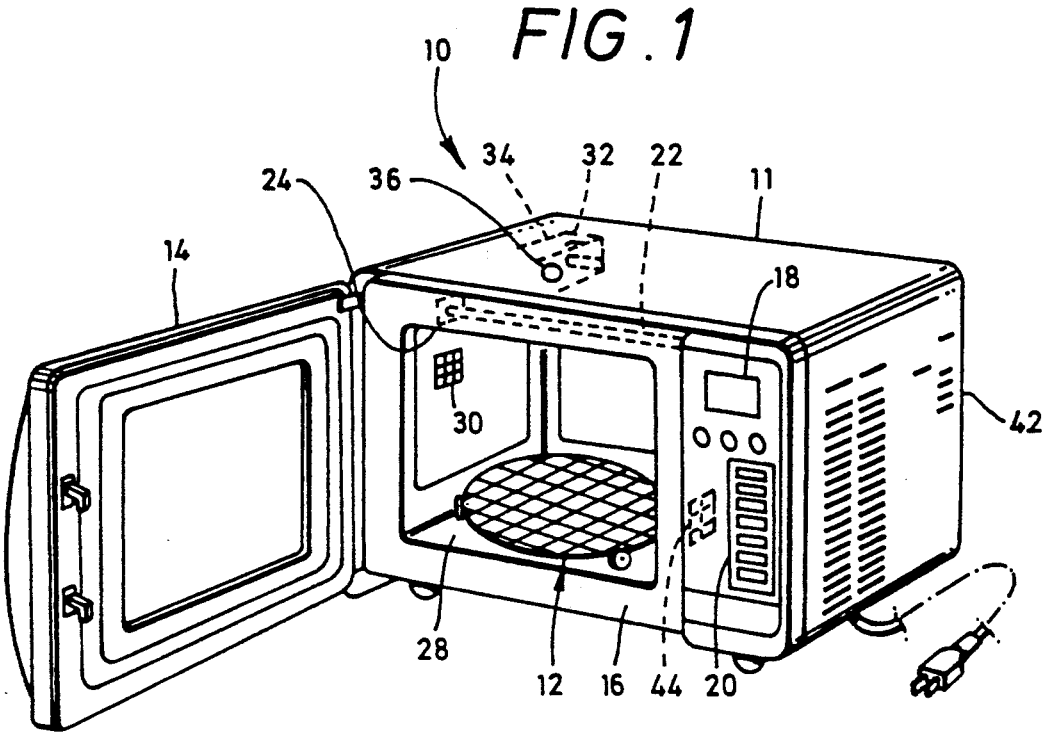
FIG. 1 view of a cooking appliance according to the present invention.

FIG. 1 shows a perspective view of a whole cooking appliance 10. The cooking appliance 10 has an outer case 11. Within the outer case 11 there is a cooking cabinet 12 for receiving food to be cooked. A door 14, which opens and closes the cooking cabinet 12, is pivotally mounted on a front surface 16 of the cooking appliance 10. A display 18 and an operation switch 20 are provided on the front surface 16. An upper heater 22 is provided on a ceiling 24 of the cooking cabinet 12. A lower heater 26 is provided out of a bottom 28 of the cooking cabinet 12. An air outlet 30, through which air within the cooking cabinet 12 is drained, is located on a side wall of the cooking cabinet 12. An exhaust hole 32, which is connected to the air outlet 30 through a duct 34, is located on a rear wall of the outer case 11. A gas sensor 36, which detects gas, such as moisture, is positioned in the duct 34. A thermistor 38 is positioned on the wall of the cooking cabinet 12. A fan 40 is located on the opposite side of the air outlet 30 in the outer case 11. The drawing hole 42 is formed on the side wall of the outer case 11. An air inlet 44, which is connected to the drawing hole 42, is formed on the opposite side of the cooking cabinet 12 against the air outlet 30. A magnetron 46 and the fan 40 are located between the drawing hole 42 and the air inlet 44. Outside air is drawn through the drawing hole 42 and the air inlet 44 due to the rotation of the fan 40, so that the outside air cools the magnetron 46, and fresh air comes into the cooking cabinet 12. While, air including moisture within the cooking cabinet 12 is exhausted through the air outlet 30, the duct 34 and the exhaust hole 32.

Figure 2:
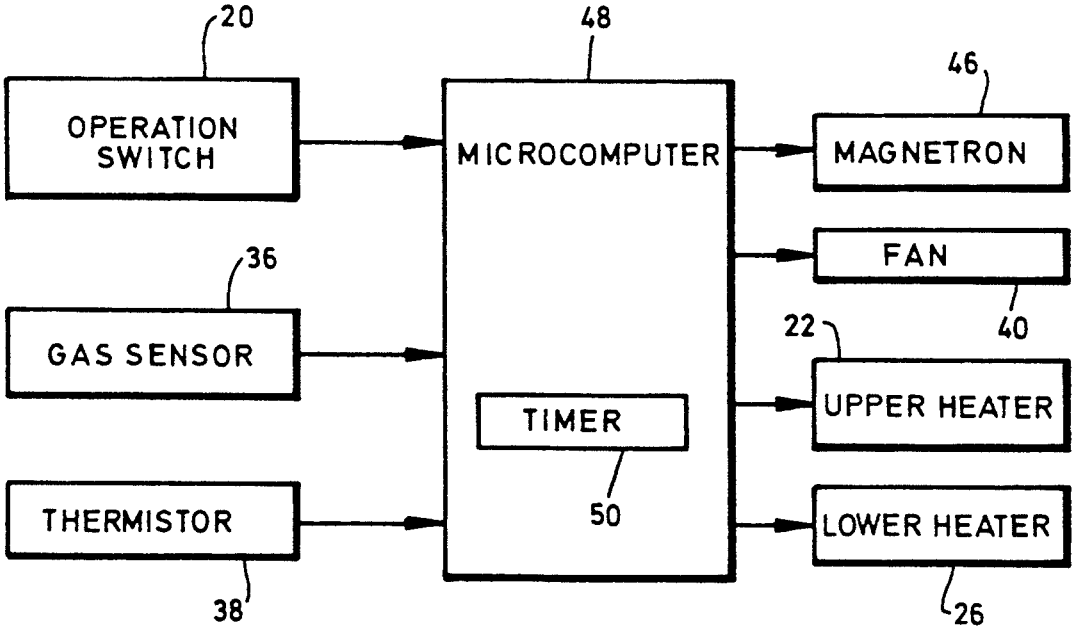
FIG. 2 is a block diagram showing an electrical arrangement of cooking appliance according to the present invention.

FIG. 2 is a block diagram of the electrical portion of the cooking appliance according to the present invention.

A microcomputer 48 having a timer 50 is located on a backside of the operation switch 20. The microcomputer 48 is connected to the gas sensor 36. Gas sensor 36 outputs a signal to the microcomputer 48 in accordance with the gas density detected by the gas sensor. The microcomputer 48 is also connected to the thermistor 38. Thermistor 38 outputs a signal to the microcomputer 48 in accordance with the temperature inside of cooking cabinet 12. The fan 40, the upper heater 22, and the lower heater 26 are connected to the microcomputer 48. The microcomputer 48 controls the fan 40, the upper heater 22, and the lower heater 26 in response to operation switch 20, the gas sensor 36, and the thermistor 38.

Figure 5:
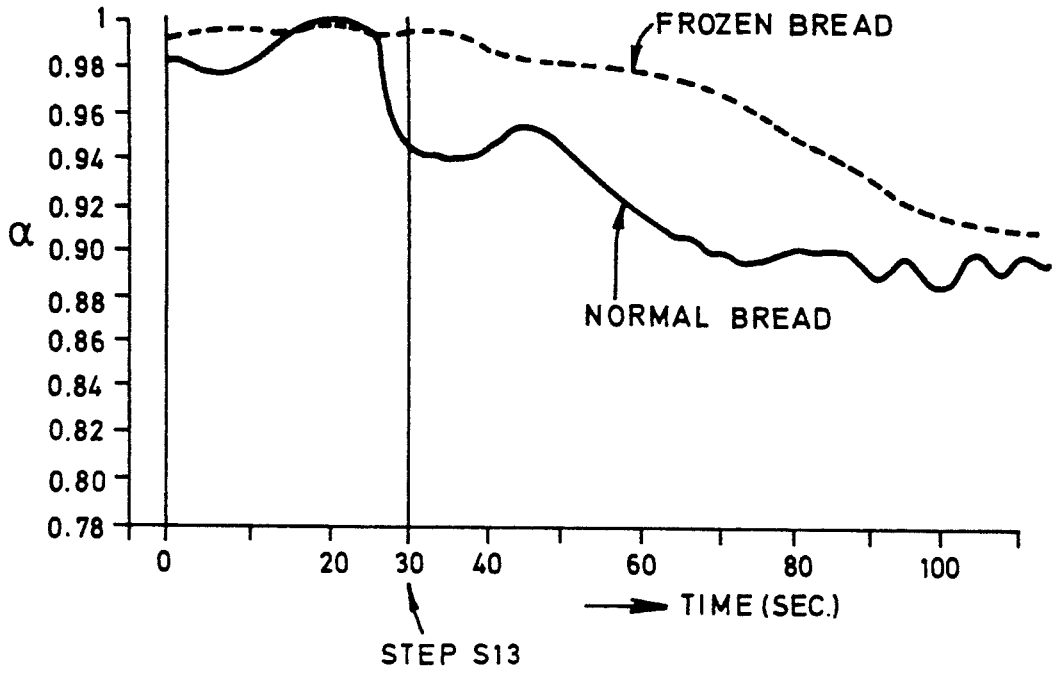
FIG. 5 shows a rate of change of moisture from a first bread toasting.

FIG. 5 is a graphical representation of experimental results indicating rates of change $\alpha$ of moisture driven from a first bread toasting when the temperature in the cabinet is low, for example, the temperature is not greater than 50° C. The dotted line indicates frozen bread. The solid line indicates normal bread.

Figure 6:
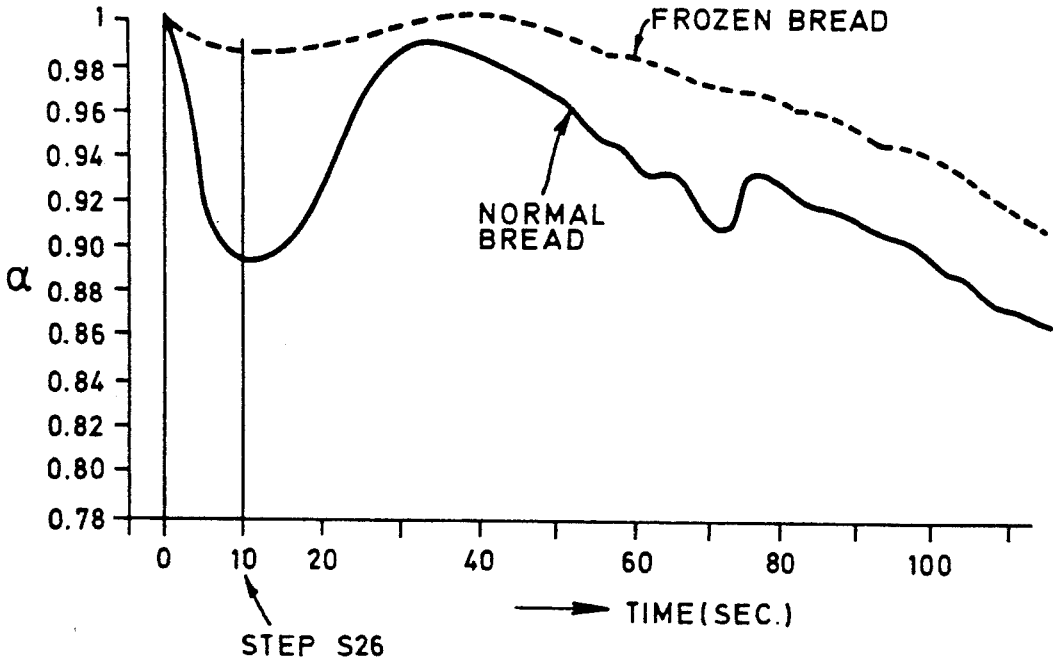
FIG. 6 shows a rate of change of moisture from a second bread toasting.

FIG. 6 is a graphical representation of experimental results indicating a rate of change $\alpha$ of moisture driven from a second bread toasting when the temperature is high, for example, the temperature in the cabinet is greater than 50° C.

Figure 7:
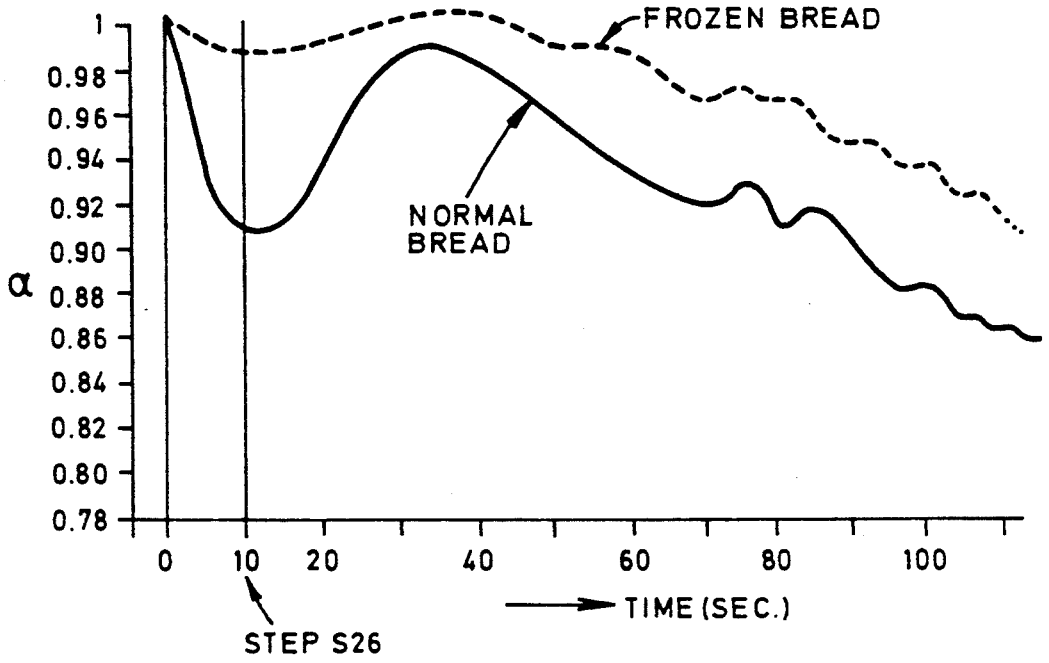
FIG. 7 shows a rate of change of moisture from a third bread toasting.

FIG. 7 is a graphical representation of experimental results indicating a rate of change of moisture from a third bread toasting when the temperature in the cabinet is high.

Figure 3:
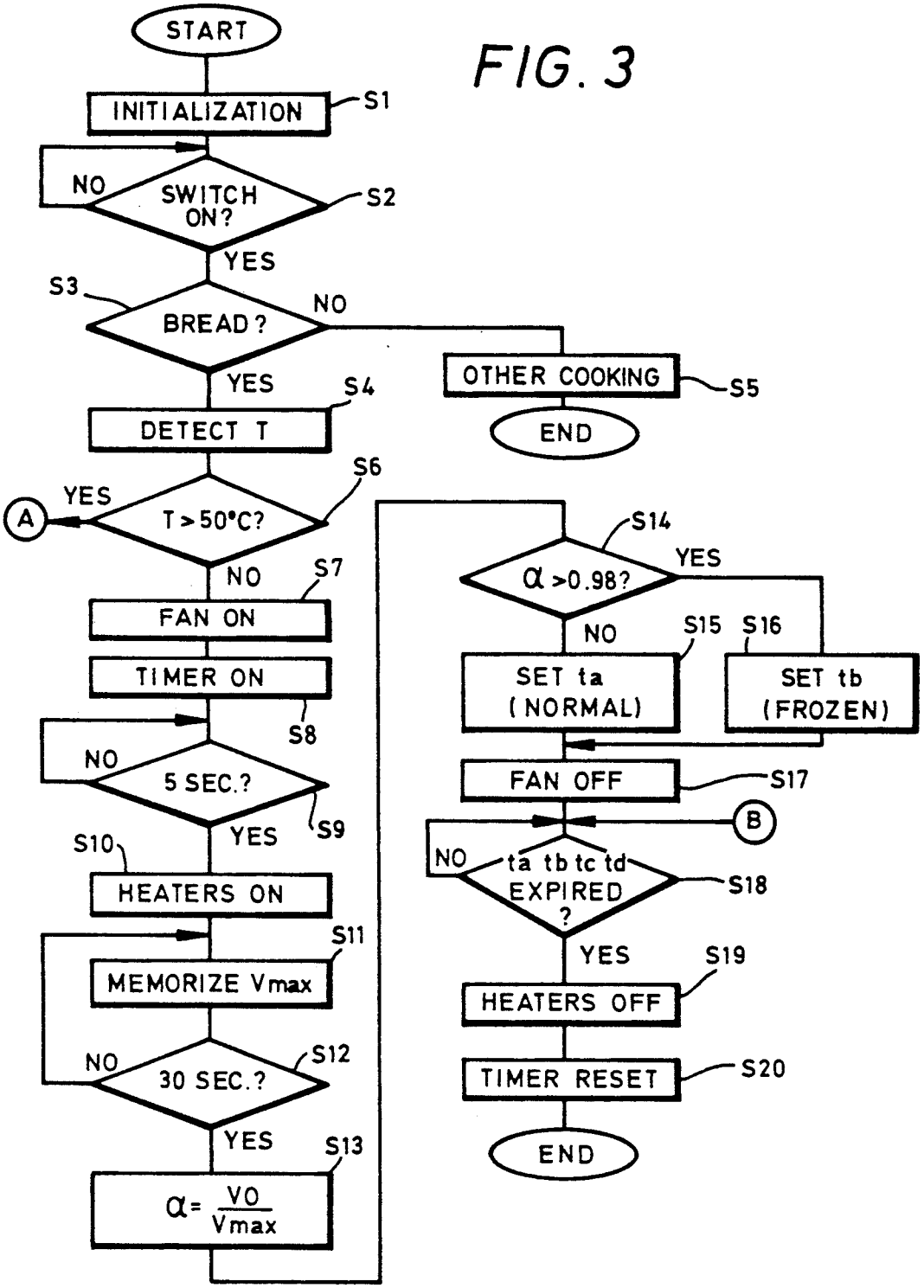
FIGS. 3 and 4 are flow charts showing operation of the cooking appliance.
Figure 4:
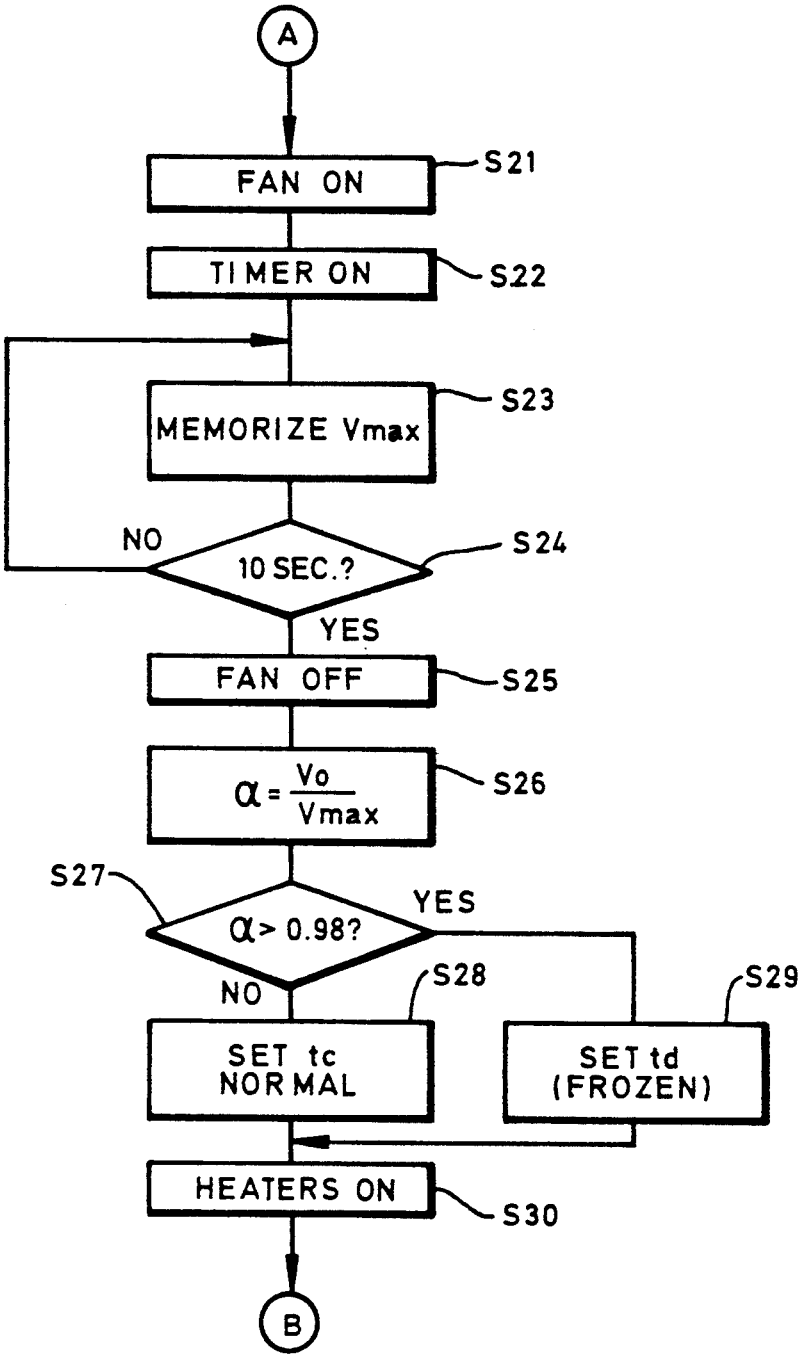

The underlying theory of operation of the invention is based on the differences depicted in FIGS. 5, 6 and 7. An operation of the cooking appliance 10, especially in the case of toasting bread, will be described with reference to FIGS. 3 and 4 which show in flow chart form, the operation of the present invention during bread toasting.

After the initialization is performed (step S1), the microcomputer 48 is waiting for a next operation derived from the operation switch 20 (step S2). Normal bread or frozen bread is loaded in the cooking cabinet 12. User presses the switch for toasting bread among the operation switch 20. The microcomputer 48 determines whether the cooking mode is toasting in a step S3. If so, the thermistor 38 detects the temperature T inside the cooking cabinet 12 in a step S4. If not, the cooking appliance 10 performs the other cooking mode at a step S5.

The microcomputer 48 determines whether the temperature T exceeds 50° C. at a step S6. If the temperature is greater than 50° C., the heater 22 does not energize, and the bread is automatically toasted by the remaining heat. Gas is promptly generated from natural bread, but gas is not promptly generated from frozen bread even if the temperature in the cabinet is high, because most gas is generated from bread in a natural condition. It takes a while for the frozen bread to melt and to thaw into a natural condition. If the temperature is not greater than 50° C., the fan rotates to draw outside air into the cooking cabinet 12 and to exhaust inside air with remaining gas in the cooking cabinet 12 through the duct 34 (step S7).

The timer 50 starts a count (step S8). When the time of the timer 50 exceeds five seconds (step S9), the microcomputer 48 actuates the upper heater 22 and the lower heater 26 to toast the bread (step S10). When the bread is toasted, moisture comes from the bread. Moisture flows nearby the gas sensor 36 in the duct 34 with air inside the cabinet 12 due to the rotation of the fan 40. The gas sensor 36 has been detecting the gas density, that is, relative volume of moisture since the heaters 22 and 26 started to heat the bread. The microcomputer 48 receives the data level Vo from the gas sensor 36 in accordance with the gas density. The microcomputer 48 sets Vmax, which is the largest value among the data level Vo for thirty seconds from the beginning of actuating the heaters 22 and 26, and the microcomputer 48 memorizes the Vmax (step S17 and S12). The microcomputer 48 calculates a change rate $\alpha$, which is a ratio Vo to Vmax (step S13).

The microcomputer 48 determines whether the change rate $\alpha$ exceeds 0.98 (step S14). If not, the microcomputer 48 sets a toasting time ta, which is suitable for the normal bread (step S15). If so, the microcomputer 48 sets a toasting time tb, which is suitable for the frozen bread (step S16).

When the normal bread is toasted, much moisture comes from the bread promptly when the heaters 22 and 26 heat the normal bread. In thirty seconds from the beginning of heating the bread, the volume of moisture, which comes from the bread, decreases rapidly (as shown in FIG. 5). When the frozen bread is toasted, moisture gradually comes from the bread when the heaters 22 and 26 heat the bread. So, the change rate $\alpha$ of the frozen bread is lower than that of the normal bread. Therefore, the microcomputer 48 can distinguish the normal bread from the frozen bread on the basis of the change rate $\alpha$.

A critical level for $\alpha$ has been determined by a experiment to be 0.98. Toasting time ta and tb are also decided by a experiment, for example, ta is four minutes ten seconds, and tb is four minutes thirty seconds.

After the step S15 or S16, the fan 40 stops the rotation thereof (step S17). The heaters 22 and 26 toast the bread for the set time, ta or tb (step S18). After the set time elapses, the heaters 22 and 26 stop toasting the bread (step S19). The timer 50 is reset (step S20).

Initial High Temperature in Cabinet

In the case of "YES" at the step 6, the flow jumps to a step S21, and the fan rotates. The timer 50 starts the counts (step S22). The gas sensor 36 has been detecting the gas density, that is, relative volume of moisture since the timer 50 started count. When the temperature is high enough, moisture comes from the bread without heating the heater 22 and 26. Moisture flows nearby the gas sensor 36 in the duct 34 due to the rotation of the fan 40. The microcomputer 48 receives the data level Vo from the gas sensor 36 in accordance with the gas density. The microcomputer 48 sets Vmax, which is the largest value among the data level Vo for ten seconds from the beginning of actuating the heaters 22 and 26, and the microcomputer 48 memorizes the Vmax (step S23 and step S24). The fan 40 stops the rotation thereof (step S25).

The microcomputer 48 calculates a change rate $\alpha$, which is a ratio Vo to Vmax (step S26). The microcomputer 48 determines whether the change rate $\alpha$ exceeds 0.98 (step S27). If the microcomputer 48 determines that the change rate $\alpha$ does not exceed 0.98 then the microcomputer 48 sets a toasting time tc, which is suitable for the normal bread when the cooking appliance 10 is used continuously (step S28). If the change rate $\alpha$ exceeds 0.98 then the microcomputer 48 sets a toasting time td, which is suitable for the frozen bread when the cooking appliance 10 is used continuously (step S29). After that, the heaters 22 and 26 start to toast the bread (step S30). The flow returns back to the step S18, so that the heaters 22 and 26 toast the bread for the set time, tc or td.

Based on the experimental results depicted in FIG. 6 and FIG. 7, the microcomputer 48 determines whether the bread is normal or frozen, based on a gas sensor reading ten seconds after the beginning of detecting gas density. Toasting time tc and td are controlled based upon experimental results previously obtained, for example, tc is three minutes ten seconds, and td is three minutes thirty seconds in a preferred embodiment.

According to the above embodiment, when the initial temperature inside the cooking cabinet 12 exceeds a predetermined temperature, for example, 50° C., the microcomputer 48 changes the decision time at which the determination as to frozen or unfrozen bread is made from thirty seconds to ten seconds. That is, when the cooking appliance 10 is used continuously, the decision time is earlier.

Using the present invention, the decision time is proper whether the cooking appliance 10 is used continuously or not. Therefore, the cooking appliance 10 toasts the bread properly whether the bread is normal or frozen, and whether the cooking appliance is used continuously or not.

Moreover, when the cooking appliance 10 begins to toast before detecting gas, any gas in the cooking cabinet 12 remaining from a previous toasting is exhausted by fan 40. As a result, the gas sensor 36 detects the gas coming from the bread being toasted. While the gas sensor 36 detects gas, gas always flows nearby the gas sensor due to the forced draft by the fan 40. As a result, the gas sensor 36 can promptly detect the gas which comes from the bread, and detection by the gas sensor can be stabilized.

Although only a single preferred embodiment has been described in detail above, those having ordinary skill in the art will certainly understand that many modification are possible in the preferred embodiment without departing from the teaching thereof.

All such modification, for example, the determined level of change rate, 0.98, is changeable, and the first determined level of change rate when the cooking appliance is used at the first time is changeable to the second level of change rate when the cooking appliance is used continuously, are intended to be encompassed within the following claims.

Moreover, the maximum value of data level Vo while the cooking appliance 10 works can be set to the Vmax. A position of the thermistor 38 is changeable, if the thermistor 38 substantially detects the temperature within the cooking cabinet 12 or of the cooking cabinet.

Alternative embodiments are also possible. In the usual case, microcomputer 48 changes a period of cooking in accordance with a condition of the food. However, as an alternative, the microcomputer may change a heating power of heaters 22 and 26. For example, if a piece of bread is determined to be frozen, heaters 22 and 26 may provide additional power than if the bread were determined to be normal (un-frozen) bread.

As a further alternative microcomputer 48 may change a temperature in cabinet 12 in accordance with the determined condition of the food. For example, if a piece of bread were determined to be frozen, the temperature in cabinet 12 would be set higher than if the bread were determined to be normal (unfrozen) bread.

What is claimed is:

1. A cooking appliance, comprising:

a) a cooking cabinet for receiving food to be cooked;

b) heating means for heating food received in the cooking cabinet;

c) a gas sensor for detecting gas inside the cabinet;

d) temperature detecting means for detecting an air temperature inside the cooking cabinet; and e) cook control means, responsive to the gas sensor and the temperature detecting means, for controlling the heating means in a manner such that when the air temperature is less than a predetermined temperature, the heating means is controlled based upon gas detected during a first predetermined period of time, and when the air temperature is greater than the predetermined temperature, the heating means is controlled based upon gas detected during a second period of time different from the first period of time.

2. A cooking appliance according to claim 1, wherein the temperature detecting means comprises means for detecting the air temperature inside the cooking cabinet when the cooking starts.

3. A cooking appliance according to claim 1, wherein the cook control means determines a condition of food in response to a signal from the gas sensor.

4. A cooking appliance according to claim 3, wherein the condition of the food is one of frozen and unfrozen.

5. A cooking appliance according to claim 1, wherein the cook control means controls a period of cooking.

6. A cooking appliance according to claim 1, wherein the gas sensor comprises a moisture detecting sensor.

7. A cooking appliance according to claim 1, wherein the cook control means controls a power of the heating means.

8. A cooking appliance according to claim 1, wherein the cook control means controls a temperature in the cooking cabinet.

9. A cooking appliance according to claim 1, wherein said first predetermined period of time is longer than the second period of time.

10. A method of operating a cooking appliance for cooking, the cooking appliance including a cooking cabinet for receiving food to be cooked, a heater for heating food received in the cooking cabinet, a gas sensor for detecting gas within the cooking cabinet, and means for determining a kind of food in response to a signal from the gas sensor, comprising the steps of:

detecting an air temperature inside the cooking cabinet, setting a first predetermined period of time during which the gas sensor detects gas inside the cabinet if the air temperature is less than a predetermined temperature, or setting a second predetermined period of time different from the first period of time if the temperature is greater than the predetermined temperature, detecting the gas for the set period of time, determining a condition of the food based on the detected gas, and controlling the heater based on the determination.

11. A method according to claim 10, wherein the step of controlling includes a step of controlling a heating period of the heater.

12. A method according to claim 10, wherein the step of controlling includes a step of controlling a power of the heater.

13. A method according to claim 10, wherein the step of controlling includes a step of controlling a temperature in the cooking cabinet.

14. A cooking appliance having a toaster arrangement, the toaster arrangement comprising:

a cabinet for receiving food to be toasted;

a heating element for heating and toasting the received food;

a gas sensor for detecting a gas density inside the cabinet;

a temperature sensor for detecting an air temperature inside the cabinet;

control means, responsive to the gas sensor and temperature sensor, for controlling the heating element such that after toasting begins and the gas density changes by greater than a predetermined amount during a first time period the control means controls the heating element for a first toasting time, and such that after toasting begins and the gas density changes by less than the predetermined amount during the first time period the control means controls the heating element for a second toasting time.

15. A cooking appliance according to claim 14, wherein the control means controls the heating element such that after toasting begins and when the air temperature is less than a predetermined temperature the heating element is activated, and such that after toasting begins and when the air temperature is greater than a predetermined temperature the heating element is activated after a second time period.

16. A cooking appliance according to claim 14, wherein the control means determines the state of the food to be toasted based on a change of gas density over the first time period.

17. A cooking appliance according to claim 14, wherein the control means controls a temperature inside the cabinet.

18. A cooking appliance according to claim 14, wherein the control means controls a heating power of the of the heating element.

* * * * *